United States Patent [19]

Sanders et al.

[11] 4,183,491

[45] Jan. 15, 1980

[54] REINFORCED PALLET

[75] Inventors: Ellsworth E. Sanders, Sanibel Island, Fla.; Edward L. Stahl, Richmond, Mich.

[73] Assignee: Pinckney Molded Plastics, Inc., Pinckney, Mich.

[21] Appl. No.: 904,865

[22] Filed: May 11, 1978

[51] Int. Cl.[2] ..... B65D 19/32

[52] U.S. Cl. ..... 248/346; 108/51.1; 108/53.3; 108/901

[58] Field of Search ..... 108/51.1, 52.1, 53.1, 108/53.3, 55.1, 56.1, 57.1, 901, 902; 248/346; 211/126, 153

[56] References Cited

U.S. PATENT DOCUMENTS

| | | | |
|---|---|---|---|
| 3,245,548 | 4/1966 | Kesilman et al. | 211/126 X |
| 3,323,656 | 6/1967 | Weiss et al. | 211/153 |
| 3,330,228 | 7/1967 | Donnelly | 108/51.1 |
| 3,549,018 | 11/1968 | Wilson | 211/126 |
| 3,567,067 | 3/1971 | Weiss | 220/71 |
| 3,648,883 | 3/1972 | Bridenstine | 220/66 |
| 3,675,815 | 7/1972 | Rehig | 211/126 X |
| 3,794,208 | 2/1974 | Roush et al. | 220/66 |
| 3,880,092 | 4/1975 | Seeber et al. | 108/51.1 |
| 3,905,478 | 9/1975 | Peterson et al. | 206/523 |
| 3,938,448 | 2/1976 | Nishitani et al. | 108/51.1 |

FOREIGN PATENT DOCUMENTS

| | | | |
|---|---|---|---|
| 2101535 | 9/1972 | Fed. Rep. of Germany | 108/51.1 |
| 2525478 | 12/1976 | Fed. Rep. of Germany | 108/51.1 |
| 588387 | 5/1977 | Switzerland | 108/51.1 |

*Primary Examiner*—Roy D. Frazier
*Assistant Examiner*—William E. Lyddane
*Attorney, Agent, or Firm*—Whittemore, Hulbert & Belknap

[57] ABSTRACT

A plastic pallet having an elongated downwardly opening channel molded into the undersurface of its bottom wall. The channel extends through the midpoint of the bottom wall from one side edge to the other and may be provided with ribs for added reinforcement. A plastic reinforcing strip is fused along substantially its full length to the channel flanges to close the space within the channel.

4 Claims, 4 Drawing Figures

REINFORCED PALLET

BACKGROUND AND SUMMARY OF THE INVENTION

Plastic pallets may be strengthened by adding glass fibers to the plastics material from which they are made. However, pallets made from glass-fiber reinforced plastics material tend to be brittle and therefore to break or fracture under the stress of impact or twisting.

One of the objects of this invention is to provide a strengthened plastic pallet which is not brittle.

Other objects and advantages of the invention will become more apparent as this description proceeds especially when taken in conjunction with the accompanying drawing wherein.

Figure 4:
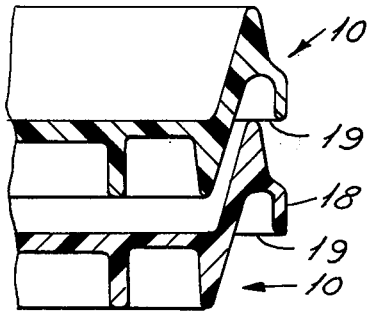
FIG. 4 is a fragmentary sectional view showing two pallets nested together.

Referring now more particularly to the drawing, the pallet 10 has a horizontal rectangular bottom wall 12 bordered along its four edges by side retaining walls 14 and end retaining walls 16. These side and end walls connect end to end and are seen to extend a short distance above the bottom wall to form a retainer for an article or articles supported on the pallet. Such side and end walls preferably flare outwardly in an upward direction to permit nesting with other pallets of identical construction as seen in FIG. 4. Outwardly and downwardly turned flanges 18 along the end and side walls form handles. Ribs 19 extend between the flanges 18 and the side and end walls of the container at spaced points to provide nesting supports which engage the top edges of a lower container as seen in FIG. 4. These ribs also keep the handle flanges 18 from spreading.

The bottom wall 12 has a downwardly opening center channel 20 extending through the midpoint of the bottom wall from edge to edge thereof, connecting at right angles into the end walls 16. The side flanges 24 of the channel extend vertically downwardly from the web 22. A central rib 21 extends along the longitudinal center line of the channel 20 from end to end thereof, being integrally connected to the web 22 and end walls 16. Diagonal and right angle ribs 23 and 25 extend from central rib 21 and are integrally joined to web 22 and channel side flanges 24. These ribs 21, 23 and 25 are preferably vertically disposed and their lower edges occupy a plane spaced above the plane of the lower edges of side flanges 24 by the thickness of the reinforcing member 34 which is described more fully hereinafter.

The bottom wall also has a peripheral channel 26 which opens downwardly, being formed by the web 28, the lower end of the side and end walls and the vertically downwardly extending flange 30. The peripheral channel 26 is interrupted by the center channel 20 although the webs 22 and 28 of the two channels merge into one another as shown in FIG. 1 and are in the horizontal plane of the supporting top surface of the bottom wall.

Figure 1:
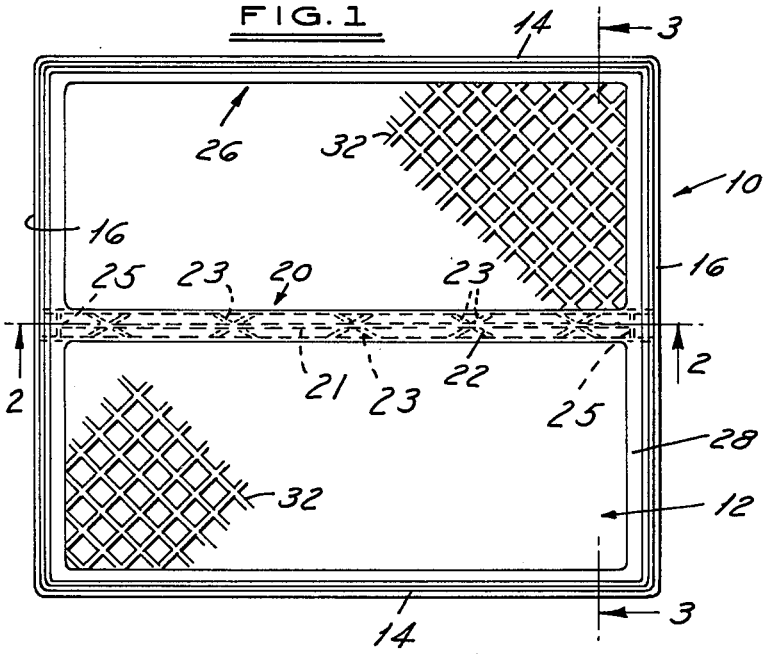
FIG. 1 is a top plan view of a pallet embodying the invention.
Figure 2:
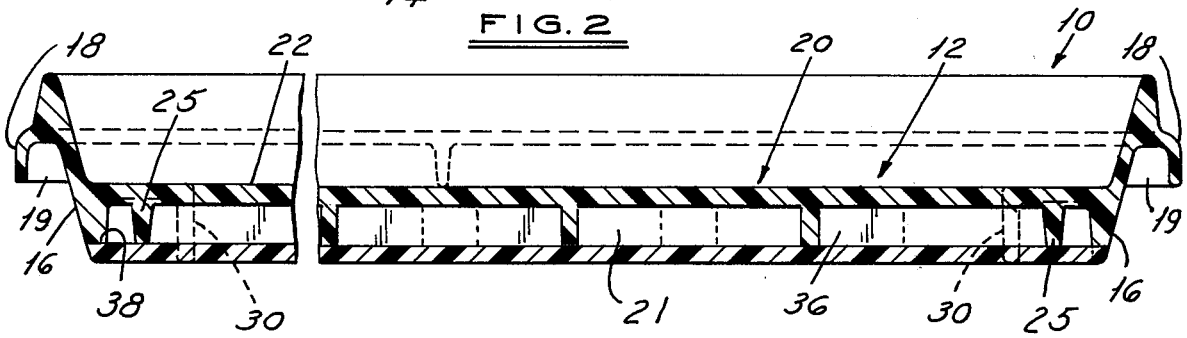
FIG. 2 is a sectional view taken on the line 2—2 in FIG. 1.
Figure 3:
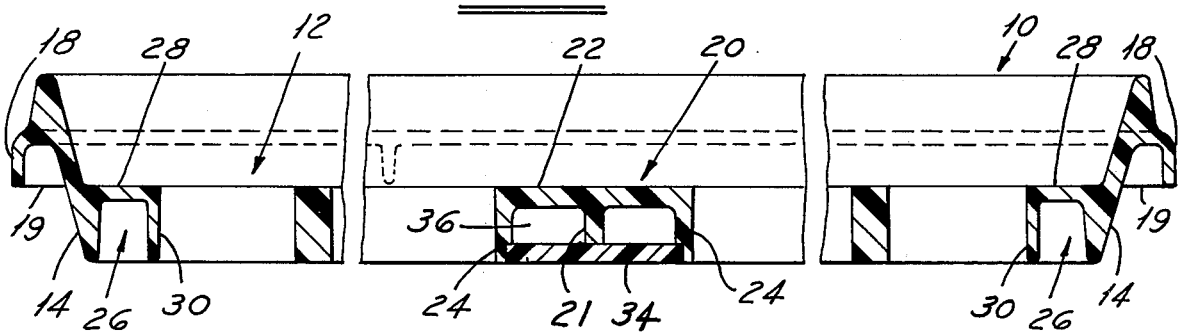
FIG. 3 is a sectional view taken on the line 3—3 in FIG. 1.

The areas bounded by the center and peripheral channels of the bottom wall have the diagonally extending crossing ribs 32 the ends of which connect into the flanges 24 and 30 of the channels and which provide an open grid construction as shown in FIG. 1. The top edges of the ribs lie in the horizontal plane of the channel webs 22 and 28 to complete the top supporting surface of the bottom wall 12. The bottom edges of the ribs and the bottom edges of the side and end walls and of the flanges 24 and 30 define the horizontal bottom of the pallet.

The pallet may be formed of any suitable plastics material such, for example, as polyethylene or polypropylene. It is of one-piece integral molded construction.

A reinforcing member 34 in the form of an elongated strip extends across the bottom of the container and is secured to the recessed bottom edges of the flanges 24 of the central channel 20 so as to be flush with the bottom edges and to close the channel space 36. Strip 34 is also in full surface-to-surface contact with the lower edges of ribs 21, 23 and 25. This reinforcing strip extends throughout the full length of the channel 22, its ends being received in notches 38 in the lower edges of the end walls 16. The bottom of the strip 34 lies in the plane of the bottom of the pallet. The reinforcing strip 34 is permanently secured to the lower edges of the channel flanges 24 throughout its full length and also to the notches 38 and ribs 21, 23 and 25 by any suitable means. Preferably, the strip is made of a suitable plastics material such as either of the ones referred to above and preferably of the same one of which the pallet is made, and is permanently secured thereto as by heating to cause fusion and a welding together of the contacting surfaces.

The reinforcing strip 34 greatly strengthens the plastic pallet without making it brittle. The pallet will withstand much greater forces of impact and the stress of twisting without breaking when reinforced by the strip 34. The provision of ribs 21, 23 and 25 and the bonding of these ribs to the reinforcing strip 34 adds even greater strength.

What we claim as our invention is:

1. A plastic pallet having a rectangular bottom wall, integral retaining walls extending upwardly along the four edges of said bottom wall, said retaining walls having lower edge portions disposed beneath the upper supporting surface of said bottom wall, said bottom wall having an elongated downwardly opening channel molded into its underside and including flanges extending downwardly from the upper supporting surface of said bottom wall, said channel extending through the midpoint of said bottom wall from one retaining wall to the opposite retaining wall at right angles thereto, said lower edge portions of said one retaining wall and said opposite retaining wall defining end walls for said channel, and an elongated reinforcing strip of plastics material, said strip extending lengthwise of said channel throughout the full length thereof and secured to the free lower edges of the channel flanges and to the lower edge portions of said one retaining wall and said opposite retaining wall to close the space within said channel.

2. A plastic pallet as defined in claim 1, wherein said strip is formed of the same plastics material as said bottom wall, and said strip is fused continuously along its full length to said channel flanges and at its ends to said lower edge portions of said one retaining wall and said opposite retaining wall, said bottom of said strip being flush with the underside of said bottom wall.

3. A plastic pallet as defined in claim 2, wherein said channel has an integral, central reinforcing rib extending along the longitudinal center line of said channel and fused to said strip along its full length.

4. A plastic pallet as defined in claim 3, wherein said channel has transverse reinforcing ribs integrally connecting said central rib and said channel flanges and fused to said strip.

* * * * *